US011730202B2

(12) United States Patent
Xu et al.

(10) Patent No.: US 11,730,202 B2
(45) Date of Patent: Aug. 22, 2023

(54) MULTI-SOURCE MICRO-VAPORIZER

(71) Applicant: Blackship Technologies Development LLC, North Chesterfield, VA (US)

(72) Inventors: Yongjie Xu, North Chesterfield, VA (US); Donovan Phillips, North Chesterfield, VA (US)

(73) Assignee: BLACKSHIP TECHNOLOGIES DEVELOPMENT LLC, North Chesterfield, VA (US)

( * ) Notice: Subject to any disclaimer, the term of this patent is extended or adjusted under 35 U.S.C. 154(b) by 225 days.

(21) Appl. No.: 17/220,342

(22) Filed: Apr. 1, 2021

(65) Prior Publication Data

US 2021/0219613 A1 Jul. 22, 2021

Related U.S. Application Data

(62) Division of application No. 16/161,515, filed on Oct. 16, 2018, now Pat. No. 11,000,072.
(Continued)

(51) Int. Cl.
*A24F 47/00* (2020.01)
*A24F 40/46* (2020.01)
(Continued)

(52) U.S. Cl.
CPC ..... *A24F 40/46* (2020.01); *A24F 40/30* (2020.01); *A24F 40/44* (2020.01); *A24F 40/485* (2020.01); *A24F 40/10* (2020.01); *A24F 40/20* (2020.01)

(58) Field of Classification Search
CPC ..... A24F 40/10; A24F 40/20; A24F 40/30; A24F 40/46; A24F 40/485
See application file for complete search history.

(56) References Cited

U.S. PATENT DOCUMENTS

2007/0074734 A1 4/2007 Braunshteyn
2014/0000638 A1* 1/2014 Sebastian ..... A24F 40/50 131/328
(Continued)

FOREIGN PATENT DOCUMENTS

CN 1039710 2/1990
CN 104284606 1/2015
(Continued)

OTHER PUBLICATIONS

U.S. Appl. No. 15/639,139, filed Jun. 2017, Xu et al.
(Continued)

*Primary Examiner* — Eric Yaary
(74) *Attorney, Agent, or Firm* — Nixon & Vanderhye P.C.

(57) ABSTRACT

A micro-vaporizer has a vaporization chamber within an interior of a body casing. At least one heating element is disposed within the vaporization chamber and a fluid transport material is at least partially disposed within the vaporization chamber. The fluid transport material has a vaporization surface portion positioned adjacent a surface of the at least one heating element and is configured for drawing a vaporizable liquid to the vaporization surface for exposure to the at least one heating element. An active material substrate is also disposed within the vaporization chamber. The active material substrate has an active surface portion positioned adjacent a second surface of the at least one heating element.

16 Claims, 7 Drawing Sheets

Related U.S. Application Data

(60) Provisional application No. 62/580,490, filed on Nov. 2, 2017.

(51) Int. Cl.

| | |
|---|---|
| ***A24F 40/30*** | (2020.01) |
| ***A24F 40/44*** | (2020.01) |
| ***A24F 40/485*** | (2020.01) |
| *A24F 40/10* | (2020.01) |
| *A24F 40/20* | (2020.01) |

(56) References Cited

U.S. PATENT DOCUMENTS

| | | | | |
|---|---|---|---|---|
| 2015/0245669 | A1* | 9/2015 | Cadieux | A24F 40/465 131/329 |
| 2016/0262456 | A1 | 9/2016 | Borkovec | |
| 2016/0324216 | A1 | 11/2016 | Li | |
| 2018/0177240 | A1* | 6/2018 | Duque | A24F 40/44 |

FOREIGN PATENT DOCUMENTS

| | | |
|---|---|---|
| WO | WO 2015/091258 | 6/2015 |
| WO | WO 2016/062777 | 4/2016 |
| WO | WO 2017/081487 | 5/2017 |
| WO | WO 2017/093357 | 6/2017 |

OTHER PUBLICATIONS

Communication including Extended European Search Report, European Patent Office, European Patent Application No. 18204032.9, dated Mar. 14, 2019, pp. 1-7.

National Intellectual Property Administration, PRC, First Office Action and Search Report, Chinese Patent Application No. 2018112720919, dated Feb. 2, 2021, pp. 1-21 (English Translation included).

* cited by examiner

MULTI-SOURCE MICRO-VAPORIZER

This application is a divisional application of U.S. Utility application Ser. No. 16/161,515, filed Oct. 16, 2018, which claims priority to U.S. Provisional No. 62/580,490, filed Nov. 2, 2017, the complete disclosures of which are incorporated herein by reference.

BACKGROUND OF THE INVENTION

The invention relates generally to micro-vaporizers and, more particularly, to micro-vaporizers having multiple sources for dispensing materials into the airstream through the micro-vaporizer.

Micro-vaporizers are devices in which a vaporizable fluid is drawn from a storage reservoir into a chamber where it is heated to vaporization temperature by a heating element. The vaporized fluid is then drawn or forced from the chamber. In products such as electronic cigarettes (also known as e-cigarettes or personal vaporizers), the vaporized fluid is drawn from the chamber through a mouthpiece and inhaled by the user. In other products the vaporized fluid is dispersed into the atmosphere.

The usual purpose of a device that uses a micro-vaporizer is to dispense one or more active substances using the vaporized fluid. In atmospheric dispensers, these substances may include materials such as deodorizing agents, fragrance, and insect repellant. In the case of personal vaporizers, the active substances typically include a flavorant (i.e., a flavoring agent or material) and nicotine. The flavorant and nicotine levels may be selected so as to mimic the experience of smoking a cigarette. In general, the vaporizable fluid has been the sole source of active substances exiting the micro-vaporizer.

SUMMARY OF THE INVENTION

An illustrative aspect of the invention provides a micro-vaporizer comprising a main body casing having a casing wall defining a case interior. The micro-vaporizer further comprises a vaporization chamber within the case interior. The vaporization chamber being defined at least in part by the casing wall and a distal chamber wall. An air flow passage is configured to provide fluid communication between a first environment external to the casing and the vaporization chamber. A vaporization products exhaust passage is configured to provide fluid communication between a second environment external to the casing and the vaporization chamber. The micro-vaporizer further comprises at least one heating element disposed within the vaporization chamber and a fluid transport material at least partially disposed within the vaporization chamber. The fluid transport material has a vaporization surface portion positioned adjacent a first surface of the at least one heating element and is configured for drawing a vaporizable liquid to the vaporization surface for exposure to the first surface of the at least one heating element. An active material substrate is also disposed within the vaporization chamber. The active material substrate has an active surface portion positioned adjacent a second surface of the at least one heating element. The micro-vaporizer also comprises a power source connected to the at least one heating element for selective powering and activation thereof.

In particular embodiments, the at least one heating element may comprise separate first and second heating elements. In these embodiments, the first and second heating elements and the active material substrate may be collectively positioned so that the active surface portion is adjacent a surface of the second heating element and is spaced away from the first heating element.

BRIEF DESCRIPTION OF THE DRAWINGS

The invention can be more fully understood by reading the following detailed description together with the accompanying drawing, in which like reference indicators are used to designate like elements, and in which.

DETAILED DESCRIPTION OF THE INVENTION

Figure 1:
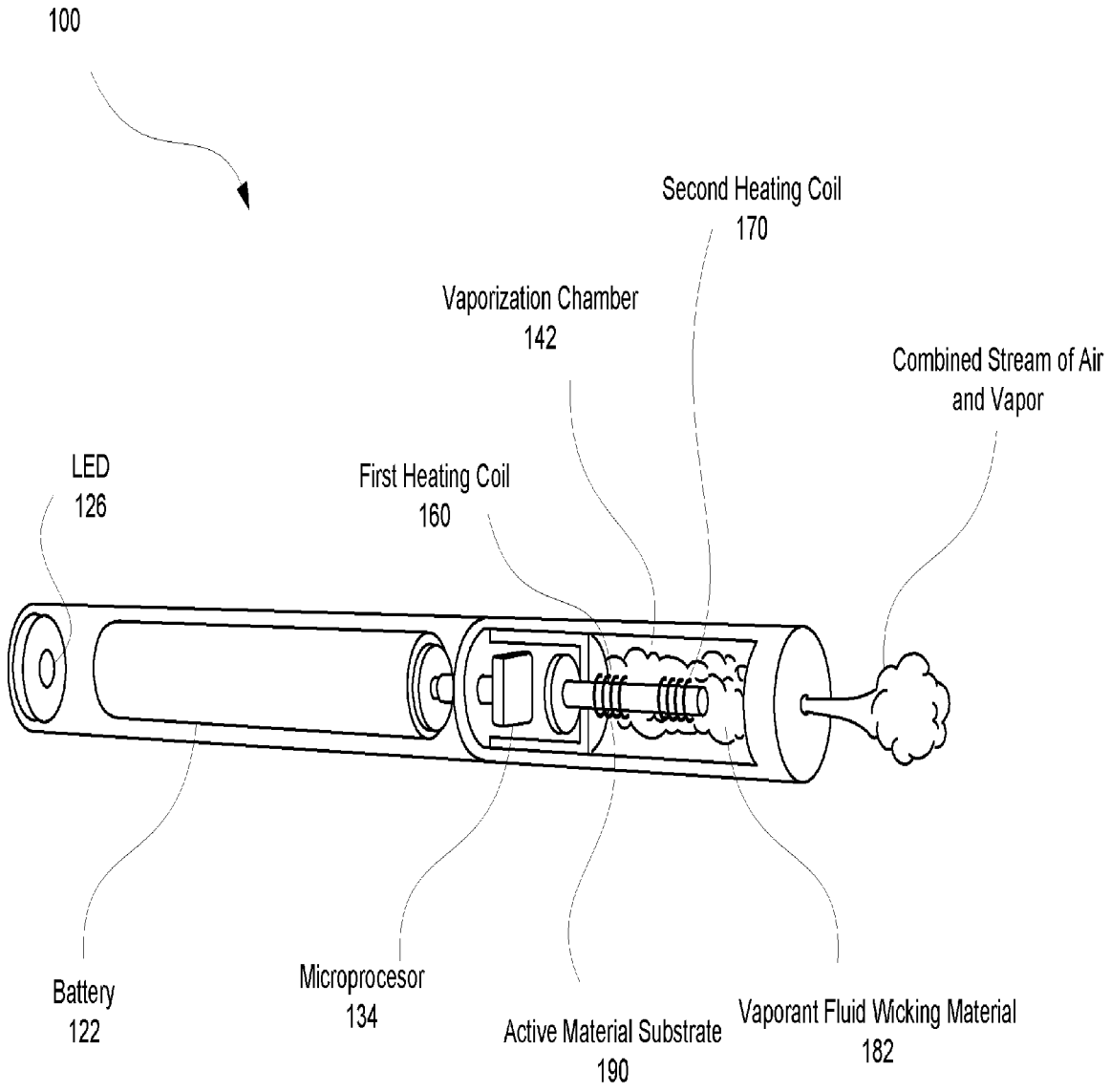
FIG. 1 is a sectioned perspective view of a personal vaporizer according to an embodiment of the invention.

The present invention provides micro-vaporizers that are configured to vaporize a fluid having one or more active materials suspended therein and to supplement the resulting vapor with one or more active materials from another source such as a solid material substrate. The solid material substrate (or active material substrate) may be formed as a monolithic or layered material or may be formed as a composite like those disclosed in U.S. patent application Ser. No. 15/639,139, filed Jun. 30, 2017 (the "'139 application"), the complete disclosure of which is incorporated herein by reference in its entirety. In particular embodiments of the invention, the solid material substrate is or comprises tobacco.

In each of various embodiments of the invention, a micro-vaporizer comprises a vaporizable fluid source from which vaporizable fluid comprising one or more active materials is drawn to or is otherwise presented to a first heat source that causes the fluid to be vaporized. The resulting vapor is mixed with air within the vaporization chamber. The micro-vaporizer also comprises an active material substrate that has at least one surface that is presented directly to a second heat source. The second heat source may be completely separate from the first. In some embodiments, the second heat source may actually be a particular portion of the first heat source that is distinct from the portion of the first heat source that is presented only to the vaporizable fluid.

As used herein, the term "active material" refers to any material that controllably alters or adds to the vaporization products of the device. Depending on the application, active materials can include, without limitation, plant material, minerals, deodorizing agents, fragrances, insect repellants, medications, and disinfectants and any material or structure containing or incorporating any of the foregoing.

In the specific instance of personal vaporizers, active materials may include flavorant substances that augment the flavorant of the vaporizable fluid. These may include, without limitation, marijuana, hemp, cannabidiol (cbd), citronella, geraniol, mint, thyme, tobacco, *Salvia dorrii, salvia,*

*Passiflora incarnata, arctostaphylos uva-ursi, Lobelia inflata*, lemon grass, cedar wood, clove, cinnamon, coumarin, helio, vanilla, menthol, eucalyptus, peppermint, rosemary, lavender, licorice, and cocoa and any material or structure containing or incorporating any of the foregoing.

In some cases, active materials may be selected based on their tendency to release flavoring or other agents upon heating. Some materials may, for example, begin to decompose or off-gas upon reaching a certain temperature. For any particular such active material, the temperature at which the material begins to decompose or off-gas is referred to herein as the material's release temperature. For a combustible active material, temperatures falling between the material's release temperature and its combustion temperature are referred to herein as being in the material's release temperature range.

One active material of particular interest for personal vaporizers is tobacco, which can be provided in the form of whole tobacco leaves, shredded tobacco leaves, crushed and dried tobacco flakes, slivers of dried tobacco leaves, and shavings from dried tobacco leaves. In some embodiments, it may be incorporated into woven or a non-woven fiber sheet with tobacco material weaved or embedded into the non-woven fiber sheet. By providing direct exposure of tobacco materials to a heat source, the present invention provides a way to mimic the smoky, burning flavor of a cigarette or cigar. This is because direct exposure results in the tobacco material being heated above its release temperature, which results in additional particles and/or gas products entering the vapor/air mixture in the vaporization chamber.

Heretofore, personal vaporizers have been limited in their ability to mimic the burning tobacco experience. The typical vaporizable fluid used in these devices may include nicotine and a flavorant intended to mimic the taste of a tobacco product, but it does not actually include tobacco. The multi-source personal vaporizers of the invention provide the ability to impart tobacco characteristics to the vaporizable fluid and to provide the ability to mimic the smoky burning sensation of a cigarette or cigar. This is accomplished by using real tobacco in the active material substrates of the devices.

The invention will be described in more detail using examples and embodiments geared primarily to personal vaporizers. It will be understood, however, that the methods of the invention are not limited to such applications and can be applied to any micro-vaporizer device.

Figure 2:
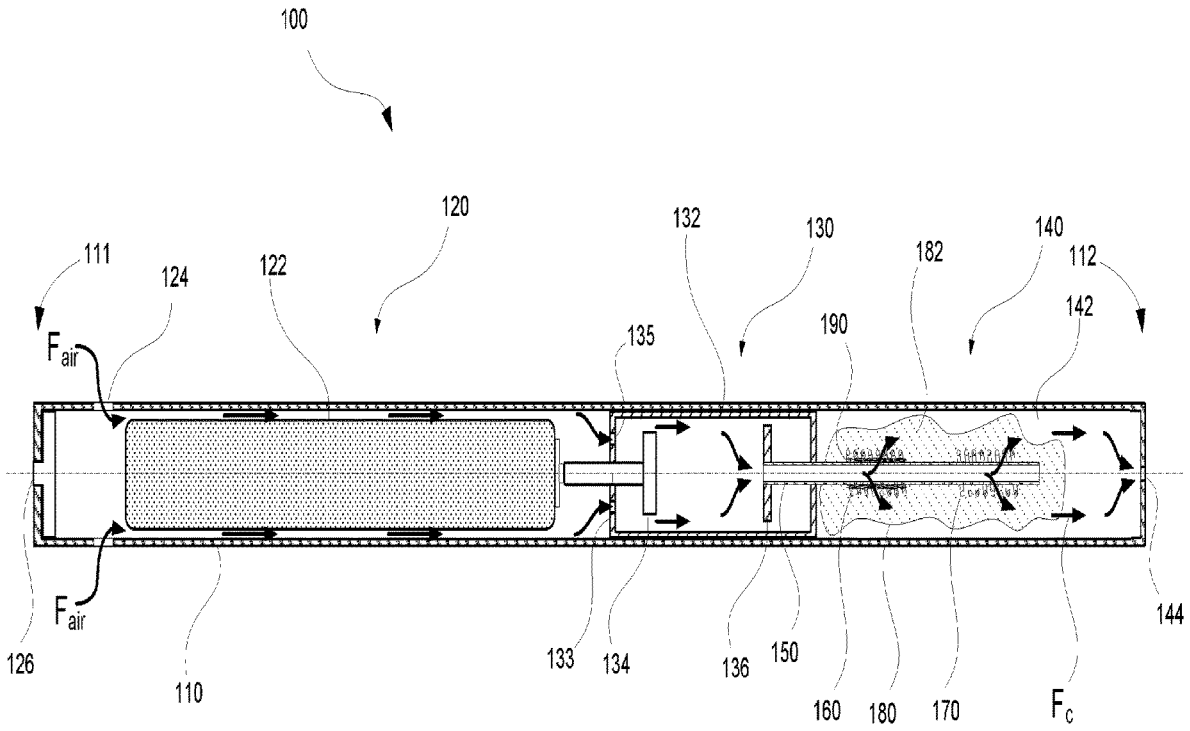
FIG. 2 is a sectioned view of a personal vaporizer according to an embodiment of the invention.
Figure 3:
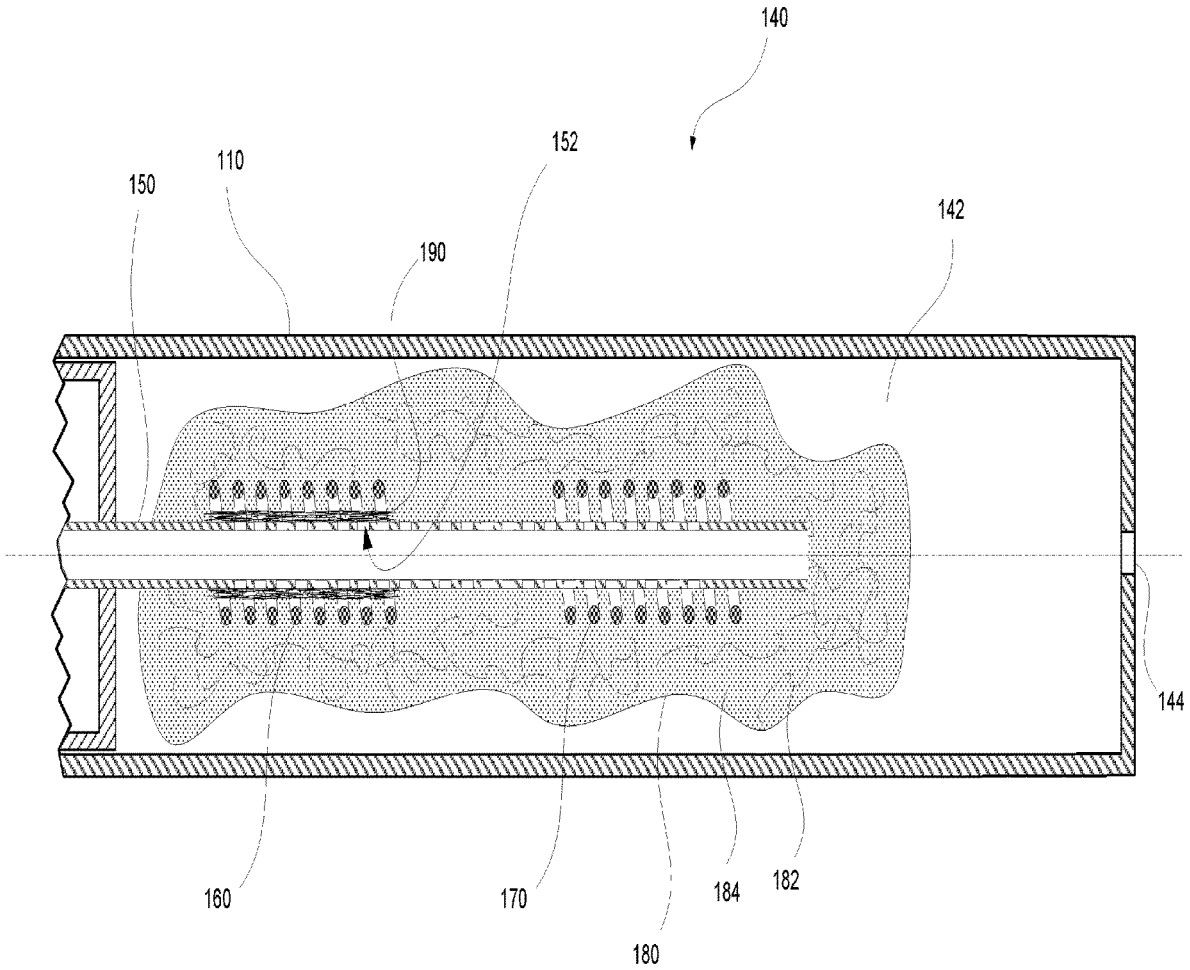
FIG. 3 is a magnified view of a portion of the personal vaporizer of FIG. 2.

FIGS. 1-3 schematically illustrate a typical, low power personal vaporizer 100 according to an illustrative aspect of the invention. The personal vaporizer 100 comprises a cylindrical casing 110 having a distal end 111 and a proximal end 112. The casing 120 has a battery portion 120 adjacent the distal end 111 in which are disposed a battery 122 and an LED 126. The casing 120 also has a microprocessor portion 130 in which is disposed a microprocessor 134 in communication with the battery 122. The vaporizer 100 may include a mechanism such as a diaphragm or other flow recognition device 136 that completes a connection between the battery 122 and the heating elements of the micro-vaporizer 100 when air is being drawn through the micro-vaporizer 100. The casing 110 also has a vaporization portion 140 defining a vaporization chamber 142 adjacent the proximal end 112. A chamber exit 144 is formed through the casing 110 at the proximal end 112 to provide fluid communication between a user's mouth and the vaporization chamber 142.

The casing 110 has one or more air holes 124 near the distal end 111 that allow air to be drawn into the interior of the device 100 from the atmosphere when a relative vacuum is applied at the chamber exit 144 (e.g., by inhalation of a device user). Fluid flow $F_{air}$ through the device 100 is illustrated by arrows. As shown, air may be drawn into the interior of the battery section 120 and around the battery 122. The air flow then passes through holes 135 formed through the wall 133 between the interior of the battery portion 120 and the interior of the microprocessor portion 130. The air is then drawn through an air tube 150 that passes from the interior of the microprocessor portion 130 into the vaporization chamber 142. The air passes into the vaporization chamber through a plurality of lateral holes 152 in the air tube 150. As will be discussed, the air mixes with vaporization products and material released from the solid material source to form combined fluid mixture $F_c$ which is drawn out of the vaporization chamber 142 through the chamber exit 144.

The personal vaporizer 100 includes a fluid reservoir 180 in the form of a wicking material 182 disposed within the vaporization chamber 142. The wicking material 182 is selected and configured to retain a vaporizable fluid 184 for heating by a vapor heating element 170. Typical wicking materials may include, but are not limited to, man-made fibers, polyblends, rayons, extrusions, etc. The vapor heating element 170 is mounted to the air tube 150 and is configured to be energized by the battery 122 when a user draws air into and through the personal vaporizer 100. The vapor heating element 170 is or includes a resistance element in the form of a wire coil. In some cases, the resistance element may be housed within a heat conductive casing. When energized, the vapor heating element 170 rapidly heats the vaporizable fluid 184 above its vaporization temperature. The resulting vapor mixes with the air flowing into the vaporization chamber 142.

Also disposed within the vaporization chamber 142 is an active material substrate 190. In this embodiment, the active material substrate 190 is formed as an annular tube surrounding the air tube 150 upstream of the vapor heating element 170. The active material substrate 190 can be positioned over some or all of the air flow holes 152 and formed so as to be permeable by air flowing through these holes 152. The substrate 190 may comprise any of the active materials previously described and may have a monolithic or composite structure.

The active material substrate 190 is surrounded by a substrate heating element 160 mounted to the air tube 150. The substrate heating element 160 may be a coiled resistance heating element similar to the vapor heating element 170. It may, however, be configured to have heating properties that are different from those of the vapor heating element 170. The substrate heating element 160 is particularly configured to heat at least the surface of the active material substrate 190 above a release temperature of the active material, which causes material to be off-gassed or otherwise released by the substrate 190. The released material passes into the air stream where it is mixed with the air and vaporization products.

As shown in FIG. 3, the substrate heating element 160 may be positioned and configured so that it also heats the vaporizable fluid 184 in the reservoir 180. This serves to provide additional fluid vaporization, the products of which are mixed with the released material from the active material substrate 190 and the vaporization products produced by the vapor heating element 170.

To use the personal vaporizer 100, a user draws air through the device by inhaling through the mouthpiece. This causes the energization of the heating elements 160, 170, which heat the vaporizable fluid 184 to a temperature above its vaporization point and the active material substrate 190 to a temperature above the release temperature of the active material. The resulting vapor/released material mixes with air in the vaporization chamber 142 and the mixture is drawn out through the chamber exit 144.

In a variation of the embodiment illustrated in FIGS. 1-3, the two heating elements could be a replaced by a single coil heating element that has a first portion that heats the active material substrate 190 and a second portion that heats only the vaporizable fluid 184. In another variation, the vaporizer 100 could have a second air tube 150 extending into the vaporization chamber. In this variation, the active material substrate 190 would be mounted to and the substrate heating element 160 would surround the second air tube 150, while the vapor heating element 170 would surround the first air tube 150.

Figure 4:
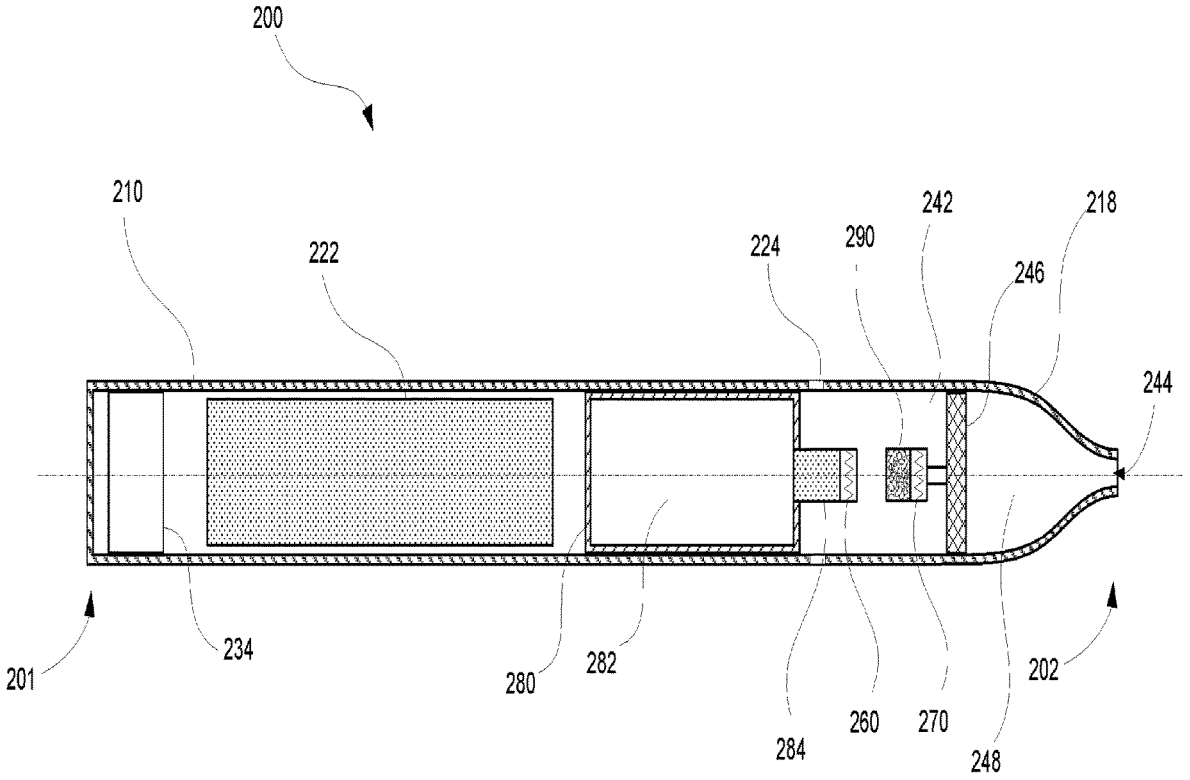
FIG. 4 is a sectioned view of a personal vaporizer according to an embodiment of the invention.

The present invention may also be applied to micro-vaporizers that wick fluid from a separate reservoir into proximity of one or more heating elements. With reference to FIG. 4, a personal vaporizer 200 comprises a cylindrical casing 210 having a distal end 201 and a proximal end 202. At its proximal end 202, the casing 210 is formed into a mouthpiece 218 having a passage 244 providing fluid communication between the atmosphere and an exit chamber 248 inside the casing 210. The casing 210 also has one or more air holes 224 to allow air to flow from the atmosphere into a vaporization chamber 242 inside the casing 210 when a relative vacuum is applied at the mouthpiece passage 244 (e.g., by inhalation of a device user). The air drawn in through the air hole(s) 224 passes through a filter 246 which divides the vaporization chamber 242 and the exit chamber 248.

The personal vaporizer 200 further comprises a fluid reservoir 280 in which is disposed a vaporizable fluid 282. The fluid reservoir 280 may be configured as a simple tank in which the fluid 282 is disposed. In some embodiments, the reservoir 280 may be or include a housed or unhoused adsorptive or absorptive material or structure that retains the vaporizable fluid 282. A fluid transport structure 284 is configured and positioned to be in contact with the fluid 282 in the reservoir 280 and for drawing the fluid 282 out of the reservoir 280 and into the vaporization chamber 242. The fluid transport structure 284 may be further configured for bringing the drawn fluid 282 into close proximity or in contact with a first heating element 260. The first heating element 260 may be configured to heat the vaporizable fluid through any conductive, convective, and/or radiative heat transfer mechanism. In typical vaporizers, the first heating element 260 is or includes a resistance element in the form of a wire coil. In some cases, the resistance element is housed within a heat conductive casing.

The fluid transport structure 284 of the personal vaporizer 200 may be or comprise a wick or collection of wicking material. Typical personal vaporizer wicks are formed from organic fiber materials such as cotton, jute, flax, cellulose, or hemp. Some non-organic materials such as silica, carbon, and non-organic polymer fibers, ceramics and steel mesh may also be used. In general, vaporizer wicks can be formed from any material that is thermally stable and that provides sufficient wicking action to transport the vaporizable fluid 282 from the reservoir 280 to the heating element 284. The fluid transport structure 284 may also comprise any of the composite wicks disclosed in the '139 application.

The personal vaporizer 200 further comprises an active material substrate 290 supported within the vaporization chamber and disposed in close proximity to a second heating element 270. The configuration and relative positioning of the active material substrate 290 and the second heating element 270 are established so that energization of the second heating element causes it to heat at least the surface of the active material substrate 290 above a release temperature of the active material, which causes material to be off-gassed or otherwise released by the substrate 290. The released material mixes with the air in the vaporization chamber 242 and with the vaporization products produced from the vaporizable fluid 282.

The illustrative personal vaporizer 200 also comprises a battery 222 for powering the heating elements 260, 270 and a control unit 234. It will be understood that the configuration and relative positioning of the components of the personal vaporizer 200 may be widely varying and that additional components (e.g., an airflow controller for regulation of the amount of air flow through the holes 224) may be included.

To use the personal vaporizer 200, a user activates the first and second heating elements 260, 270 and draws air through the device by inhaling through the mouthpiece 218. The vaporizable fluid 282 in the chamber 242 is heated to its vaporization point by the first heating element 260. At the same time, some or all of the active material substrate 290 is heated to a temperature above its release temperature by the second heating element 270. Vapor from the vaporized fluid 282 and active material released from the active material substrate mixes with air drawn through the air holes 224 and the mixture is drawn through the filter 246 and the exit chamber 248 and out through the mouthpiece passage 244.

Figure 5:
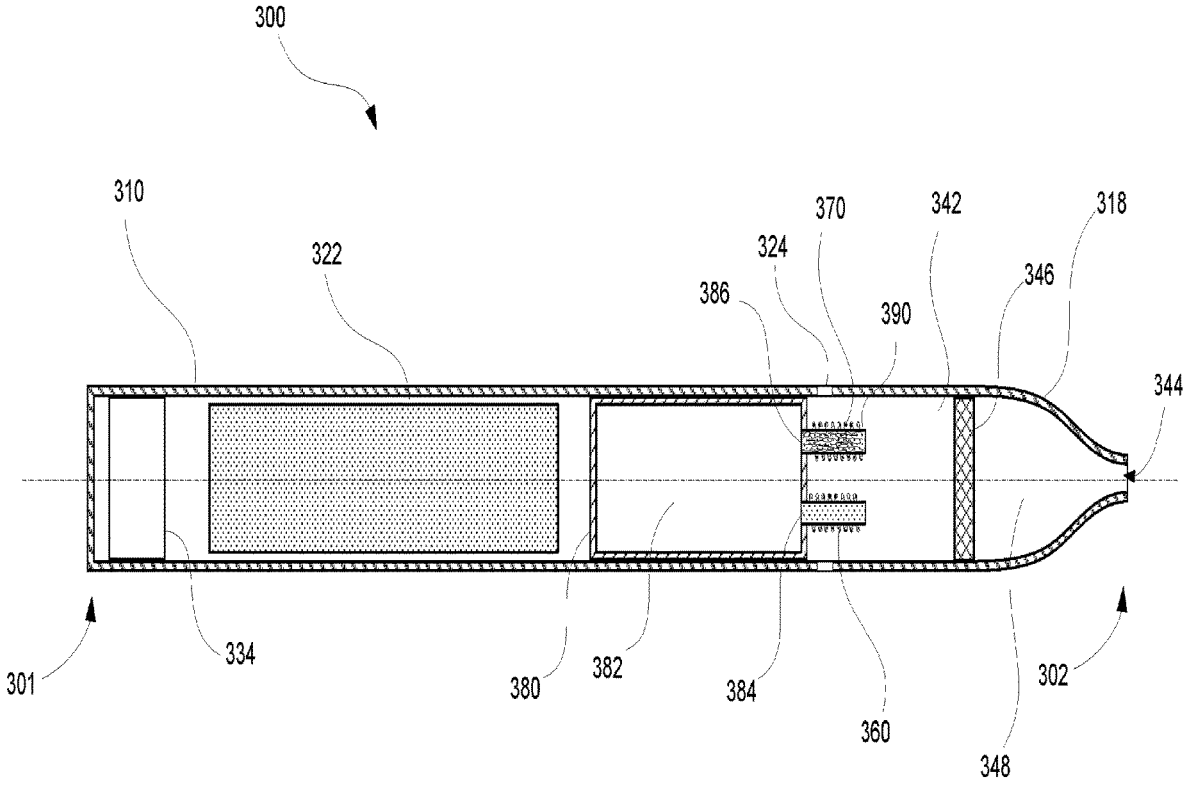
FIG. 5 is a sectioned view of a personal vaporizer according to an embodiment of the invention.

FIG. 5 illustrates another exemplary embodiment of the invention. As shown in FIG. 5, a personal vaporizer 300 comprises a cylindrical casing 310 having a distal end 301 and a proximal end 302. At its proximal end 302, the casing 310 is formed into a mouthpiece 318 having a passage 344 providing fluid communication between the atmosphere and an exit chamber 348 inside the casing 310. The casing 310 also has one or more air holes 324 to allow air to flow from the atmosphere into a vaporization chamber 342 inside the casing 310 when a relative vacuum is applied at the mouthpiece passage 344 (e.g., by inhalation of a device user). The air drawn in through the air hole(s) 324 passes through a filter 346 which divides the vaporization chamber 342 and the exit chamber 348.

The personal vaporizer 300 further comprises a fluid reservoir 380 in which is disposed a vaporizable fluid 382. The fluid reservoir 380 may be configured as a simple tank in which the fluid 382 is disposed. In some embodiments, the reservoir 380 may be or include a housed or unhoused adsorptive or absorptive material or structure that retains the vaporizable fluid 382. A first fluid transport structure 384 is configured and positioned to be in contact with the fluid 382 in the reservoir 380 and for drawing the fluid 382 out of the reservoir 380 and into the vaporization chamber 342. The first fluid transport structure 384 is further configured for bringing the drawn fluid 382 into close proximity or in contact with a first heating element 360. In the illustrated embodiment, the first heating element 360 comprises a coiled resistance heating element that surrounds at least a portion of the first fluid transport structure 384. It will be understood, however, that the first heating element 360 may be configured to heat the vaporizable fluid through any conductive, convective, and/or radiative heat transfer mechanism. The first fluid transport structure 384 may be or comprise any of the previously described wick structures/materials.

The personal vaporizer 300 also comprises a second fluid transport structure 386 configured and positioned to be in contact with the fluid 382 in the reservoir 380 and for drawing the fluid 382 out of the reservoir 380 and into the vaporization chamber 342. At least a portion of the second fluid transport structure 386 is surrounded by a porous active material substrate 390, which in turn, is surrounded by a second heating element 370 comprising a coiled resistance heating element. The second fluid transport structure 386 and the active material substrate 390 are configured and positioned so that vaporizable fluid 382 drawn from the reservoir 380 is brought into close proximity with the second heating element 370 for vaporization thereby. The active material substrate 390 is further configured and positioned so that energization of the second heating element 370 causes it to heat at least a portion of the active material substrate 390 above a release temperature of the active material, which causes material to be off-gassed or otherwise released by the substrate 390. The released material mixes with the vaporization products produced by both heating elements 360, 370.

In an alternative embodiment, the active material substrate may be incorporated into the second fluid transport structure 386 in such a way that active material is adjacent and/or directly exposed to the second heating element 370. Such transport structures may be or include, for example, wicks like those of the '139 application that incorporate an active material into a composite structure.

The illustrative personal vaporizer 300 also comprises a battery 322 for powering the heating elements 360, 370 and a control unit 334.

To use the personal vaporizer 300, a user activates the first and second heating elements 360, 370 and draws air through the device by inhaling through the mouthpiece 218. The vaporizable fluid 382 in the chamber 342 is heated to its vaporization point by the first and second heating elements 360, 370. At the same time, some or all of the active material substrate 390 is heated to a temperature above its release temperature by the second heating element 370. Vapor from the vaporized fluid 382 and active material released from the active material substrate mixes with air drawn through the air holes 324 and the mixture is drawn through the filter 346 and the exit chamber 348 and out through the mouthpiece passage 344.

Figure 6:
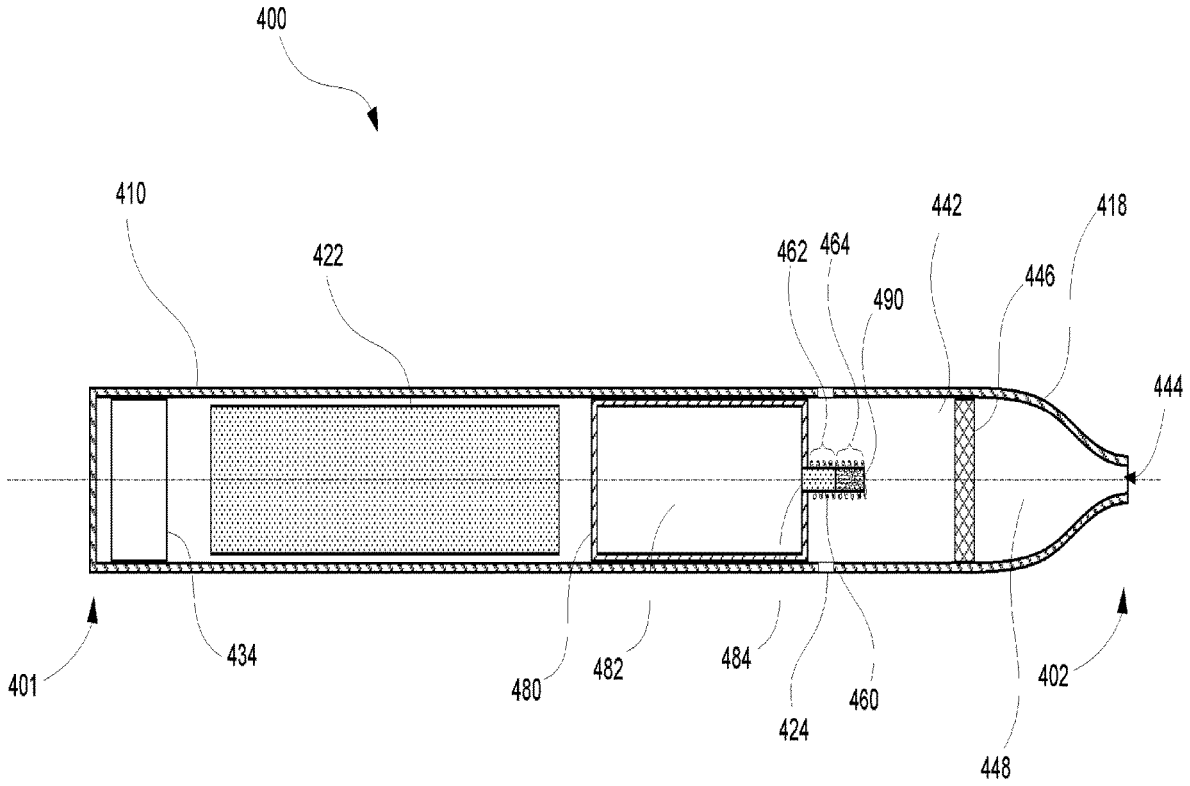
FIG. 6 is a sectioned view of a personal vaporizer according to an embodiment of the invention.
Figure 7:
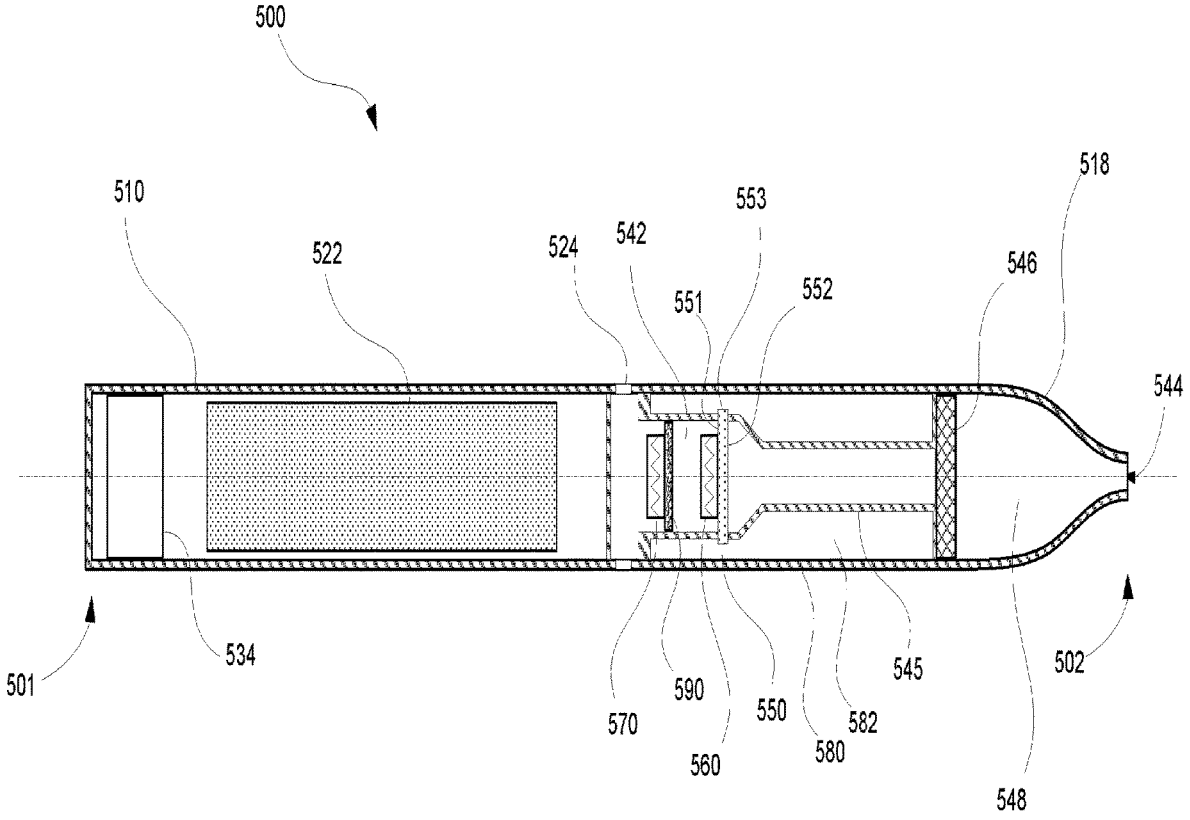
FIG. 7 is a sectioned view of a personal vaporizer according to an embodiment of the invention.

With reference to FIG. 6, another exemplary embodiment of the invention provides a personal vaporizer 400 that is similar to the personal vaporizer 300 of FIG. 5. Like the personal vaporizer 300, the personal vaporizer 400 comprises a cylindrical casing 410 having a distal end 401 and a proximal end 402, and a mouthpiece 418 having a passage 444 from an exit chamber 448. The casing 410 also has one or more air holes 424 to allow air to flow from the atmosphere into a vaporization chamber 442. The air drawn in through the air hole(s) 424 passes through a filter 446 which divides the vaporization chamber 442 and the exit chamber 448. The personal vaporizer 400 also comprises a battery 422, a control unit 434, and a fluid reservoir 480 in which is disposed a vaporizable fluid 482.

The personal vaporizer 400 differs from the previous embodiment in that it uses only a single fluid transport structure 484 is configured and positioned to be in contact with the fluid 482 in the reservoir 480 and for drawing the fluid 482 out of the reservoir 480 and into the vaporization chamber 442. A proximal portion of the fluid transport structure 484 is surrounded by a porous active material substrate 490. The fluid transport structure 484 is configured for transporting fluid 482 into close proximity or in contact with a first portion 462 of a coiled resistance heating element 460 and through the active material substrate 490 into close proximity or in contact with a second portion 464 of the coiled resistance heating element 460. The first fluid transport structure 484 may be or comprise any of the previously described wick structures/materials.

In an alternative embodiment, the active material substrate may be incorporated into a portion of the fluid transport structure 484 in such a way that active material is adjacent and/or directly exposed to the second portion 464 of the heating element 460. Such transport structures may be or include, for example, wicks like those of the '139 application that incorporate an active material into a composite structure.

In another alternative embodiment, multiple heating elements could be used in a manner similar to that in the personal vaporizer 100 of FIGS. 1-3.

In the personal vaporizer 400 of FIG. 6, energization of the heating element 460 results in vaporization of the vaporizable fluid 482 alone at one portion of the fluid transport structure 484 and in both vaporization of the fluid 482 and release of material from the active material substrate 490 at another portion of the fluid transport structure 484. The released material and the vaporization products are mixed with the air drawn into the vaporization chamber 442 through holes 424. The combined mixture is then drawn through the filter 446 into the exit chamber 448 and out through the exit 444.

FIG. 12 provides yet another illustrative example of a multi-source personal vaporizer according to the invention. Like previous embodiments, the personal vaporizer 500 comprises a cylindrical casing 510 having a distal end 501 and a proximal end 502, a mouthpiece 518 having an exit passage 544, a filter 546 and an exit chamber 548. The casing 510 also has one or more air holes 524 to allow air to flow from the atmosphere into a vaporization chamber 542. The personal vaporizer 500 also comprises a battery 522 and a control unit 534.

The personal vaporizer 500 differs from the previous embodiments in that it has a cylindrical fluid reservoir 580 that surrounds a portion of the vaporization chamber 542 and first and second heating elements 560, 570. The heating elements 560, 570 may advantageously be, for example, a coil or circular mesh resistance element. The first heating element 560 is positioned at or near the proximal end of the vaporization chamber 542, which is in fluid communication with a chimney 545 bounded by the inner wall of the reservoir 580. The chimney 545 provides a conduit through which air and vaporization products pass from the vaporization chamber 542 to the filter 546 and exit chamber 548.

To supply fluid for vaporization by the first heating element 560, the personal vaporizer 500 is provided with a disc-like fluid transport structure 584 having distal, proximal and circumferential surfaces 551, 552, 553. The fluid transport structure 584 is centered on the longitudinal axis of the personal vaporizer 500 so that its distal surface 551 is adjacent or in contact with the heating element 560. The fluid transport structure 584 is sized so that it extends outward to and through a circumferential opening in the inner wall of the fluid reservoir 580. The fluid transport structure 584 is configured so that fluid in the reservoir 580 is drawn through the circumferential surface 556 and/or through portions of the distal and proximal surfaces 551, 552 adjacent the circumferential surface 556. The fluid transport structure 584 is further configured so that the vaporizable fluid is drawn inwardly toward the longitudinal axis of the personal vaporizer 500 and proximally toward the proximal surface 552 where it is exposed to heat from the heating element 560 and vaporized. The fluid transport structure 584 may be or comprise any of the previously described wick structures/materials.

The personal vaporizer 500 also includes an active material substrate 590 positioned within the vaporization chamber 542. The active material substrate 590 is positioned in close proximity or in contact with the second heating element 570. The configuration and relative positioning of the active material substrate 590 and the second heating element 570 are established so that energization of the second heating element causes it to heat at least the surface of the active material substrate 590 above a release temperature of the active material, which causes material to be off-gassed or otherwise released by the substrate 590. The released material mixes with the air in the vaporization chamber 542 and with the vaporization products produced from the vaporizable fluid 582.

While the foregoing illustrates and describes exemplary embodiments of this invention, it is to be understood that the invention is not limited to the construction disclosed herein. The invention can be embodied in other specific forms without departing from the spirit or essential attributes.

What is claimed is:

1. A micro-vaporizer comprising:

a main body casing having a casing wall defining a case interior;

a vaporization chamber within the case interior, the vaporization chamber being defined at least in part by the casing wall and a distal chamber wall;

an air flow passage configured to provide fluid communication between a first environment external to the main body casing and the vaporization chamber;

a vaporization products exhaust passage configured to provide fluid communication between a second environment external to the main body casing and the vaporization chamber;

at least one heating element disposed within the vaporization chamber;

a fluid reservoir disposed within the case interior separate from the vaporization chamber, the fluid reservoir being configured for disposition of vaporizable liquid therein;

a fluid transport material at least partially disposed within the vaporization chamber, the fluid transport material having a vaporization surface portion positioned adjacent a first surface of the at least one heating element and being configured for drawing a vaporizable liquid to the vaporization surface for exposure to the first surface of the at least one heating element;

a fluid transport structure configured for transporting vaporizable liquid from the fluid reservoir into the vaporization chamber, the fluid transport structure including a first wick comprising at least a portion of the fluid transport material and having a first wick intake surface positioned so as to contact vaporizable liquid within the reservoir and a first wick exit surface that is or includes at least a portion of the vaporization surface portion of the fluid transport material;

an active material substrate disposed within the vaporization chamber, the active material substrate having an active surface portion positioned adjacent a second surface of the at least one heating element; and a power source connected to the at least one heating element for selective powering and activation thereof, wherein the first wick is formed as a cylindrical structure extending into the vaporization chamber and the at least one heating element comprises a coil element positioned to surround at least a portion of the first wick, and wherein the active material substrate is formed around a circumferential surface of the first wick along a portion of its length so that the coil element surrounds the active material substrate.

2. A micro-vaporizer according to claim 1 wherein the at least one heating element comprises separate first and second heating elements, and wherein the first and second heating elements and the active material substrate are collectively positioned so that the active surface portion is adjacent a surface of the second heating element and is spaced away from the first heating element.

3. A micro-vaporizer according to claim 2 wherein the first heating element operates at a first temperature and the second heating element operates at a second temperature different from the first temperature.

4. A micro-vaporizer according to claim 3 wherein the second temperature is selected so that activation of the second heating element heats the active material substrate to a temperature equal to or above an active material release temperature.

5. A micro-vaporizer according to claim 1 wherein the active material substrate comprises at least one of the set consisting of a plant material, a minerals, a deodorizing agent, a fragrance, an insect repellant, a medication, and a disinfectant.

6. A micro-vaporizer according to claim 1 wherein the active material substrate comprises tobacco.

7. A micro-vaporizer according to claim 1 wherein the at least one heating element includes a second coil element positioned to surround the first wick along a second portion of its length.

8. A micro-vaporizer comprising:

a main body casing having a casing wall defining a case interior;

a vaporization chamber within the case interior, the vaporization chamber being defined at least in part by the casing wall and a distal chamber wall;

an air flow passage configured to provide fluid communication between a first environment external to the main body casing and the vaporization chamber;

a vaporization products exhaust passage configured to provide fluid communication between a second environment external to the main body casing and the vaporization chamber;

at least one heating element disposed within the vaporization chamber;

a fluid reservoir disposed within the case interior separate from the vaporization chamber, the fluid reservoir being configured for disposition of vaporizable liquid therein;

a fluid transport material at least partially disposed within the vaporization chamber, the fluid transport material having a vaporization surface portion positioned adjacent a first surface of the at least one heating element and being configured for drawing a vaporizable liquid to the vaporization surface for exposure to the first surface of the at least one heating element;

a fluid transport structure configured for transporting vaporizable liquid from the fluid reservoir into the vaporization chamber, the fluid transport structure including a first wick comprising at least a portion of the fluid transport material and having a first wick intake surface positioned so as to contact vaporizable liquid within the reservoir and a first wick exit surface that is or includes at least a portion of the vaporization surface portion of the fluid transport material;

an active material substrate disposed within the vaporization chamber, the active material substrate having an active surface portion positioned adjacent a second surface of the at least one heating element; and a power source connected to the at least one heating element for selective powering and activation thereof, wherein the fluid transport structure includes a second wick, the first and second wicks each comprising a portion of the fluid transport material, the second wick having a second wick intake surface positioned so as to contact vaporizable liquid within the reservoir and a second wick exit surface that includes a second portion of the vaporization surface portion of the fluid transport material, wherein the first and second wicks are each formed as a cylindrical structure extending into the vaporization chamber, wherein the active material substrate is formed around a circumferential surface of the second wick along a portion of its length, and wherein the at least one heating element comprises a first coil element positioned to surround at least a portion of the first wick and a second coil element positioned to surround the active material substrate and the second wick along the portion of its length.

9. A micro-vaporizer according to claim 1 wherein the micro-vaporizer is configured for use as a personal vaporizer having a mouthpiece attached to the main casing, the mouthpiece having an exit port and defining at least a portion of the vaporization products exhaust passage, and wherein the second environment is a user's mouth during inhalation.

10. A micro-vaporizer comprising:

a main body casing having a casing wall defining a case interior;

a vaporization chamber within the case interior, the vaporization chamber being defined at least in part by the casing wall and a distal chamber wall;

an air flow passage configured to provide fluid communication between a first environment external to the main body casing and the vaporization chamber;

a vaporization products exhaust passage configured to provide fluid communication between a second environment external to the main body casing and the vaporization chamber;

at least one heating element disposed within the vaporization chamber;

a fluid reservoir disposed within the case interior separate from the vaporization chamber, the fluid reservoir being configured for disposition of vaporizable liquid therein;

a first wick having a first wick intake surface and a first wick exit surface, the first wick being positioned so that the first wick intake surface contacts vaporizable liquid within the reservoir and so that at least a portion of the first wick exit surface is adjacent a first surface of the at least one heating element, the first wick being configured for drawing the vaporizable liquid from the fluid reservoir to the first wick exit surface for exposure to the first surface of the at least one heating element;

an active material substrate disposed within the vaporization chamber, the active material substrate having an active surface portion positioned adjacent a second surface of the at least one heating element; and a power source connected to the at least one heating element for selective powering and activation thereof, wherein the first wick is formed as a cylindrical structure extending into the vaporization chamber and the at least one heating element comprises a coil element positioned to surround at least a portion of the first wick, and wherein the active material substrate is formed around a circumferential surface of the first wick along a portion of its length so that the coil element surrounds the active material substrate.

11. A micro-vaporizer according to claim 10 wherein the at least one heating element includes a second coil element positioned to surround the first wick along a second portion of its length.

12. A micro-vaporizer according to claim 10 further comprising:

a second wick having a second wick intake surface and a second wick exit surface, the second wick being positioned so that the second wick intake surface contacts vaporizable liquid within the reservoir and so that at least a portion of the second wick exit surface is adjacent a second surface of the at least one heating element, the second wick being configured for drawing the vaporizable liquid from the fluid reservoir to the second wick exit surface for exposure to the second surface of the at least one heating element.

13. A micro-vaporizer according to claim 8 wherein the active material substrate comprises at least one of the set consisting of a plant material, a minerals, a deodorizing agent, a fragrance, an insect repellant, a medication, and a disinfectant.

14. A micro-vaporizer according to claim 8 wherein the active material substrate comprises tobacco.

15. A micro-vaporizer according to claim 10 wherein the active material substrate comprises at least one of the set consisting of a plant material, a minerals, a deodorizing agent, a fragrance, an insect repellant, a medication, and a disinfectant.

16. A micro-vaporizer according to claim 10 wherein the active material substrate comprises tobacco.

* * * * *